US011127327B2

(12) United States Patent
Kim et al.

(10) Patent No.: US 11,127,327 B2
(45) Date of Patent: Sep. 21, 2021

(54) DISPLAY DRIVING DEVICE AND DISPLAY DEVICE INCLUDING THE SAME

(71) Applicant: Silicon Works Co., Ltd., Daejeon (KR)

(72) Inventors: Myung Yu Kim, Daejeon (KR); Do Seok Kim, Daejeon (KR); Hyun Pyo Cho, Daejeon (KR); Yong Hwan Moon, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/925,292

(22) Filed: Jul. 9, 2020

(65) Prior Publication Data

US 2021/0193002 A1 Jun. 24, 2021

(30) Foreign Application Priority Data

Dec. 24, 2019 (KR) ..... 10-2019-0174231

(51) Int. Cl.
*G09G 3/20* (2006.01)

(52) U.S. Cl.
CPC ..... *G09G 3/20* (2013.01); *G09G 2310/08* (2013.01)

(58) Field of Classification Search
CPC ..... G09G 5/008
See application file for complete search history.

(56) References Cited

U.S. PATENT DOCUMENTS 11,004,423 B2 * 5/2021 Tzeng ..... G09G 5/005
2013/0076703 A1 * 3/2013 Baek ..... G09G 3/2092 345/204
2013/0215090 A1 * 8/2013 Kim ..... G09G 3/36 345/204
2016/0125840 A1 * 5/2016 Oh ..... G09G 5/008 345/213
2017/0111071 A1 * 4/2017 Yoo ..... H04L 25/03878
2017/0132966 A1 * 5/2017 Lim ..... G09G 5/18

FOREIGN PATENT DOCUMENTS

KR 20130022159 B1 3/2013
KR 20150125145 A 11/2015
KR 20190077937 A 7/2019
KR 20200007283 A 1/2020

* cited by examiner

*Primary Examiner* — Sepehr Azari
(74) *Attorney, Agent, or Firm* — Polsinelli PC

(57) ABSTRACT

The present disclosure discloses a display driving device and a display device including the same, which are capable of restoring a communication abnormal state to a normal state when a communication abnormality occurs due to an unexpected variable during communication between a timing controller and a plurality of source drivers. The display device may include a timing controller configured to transmit a communication signal, a first source driver connected to the timing controller through a first communication link and configured to receive the communication signal, and a second source driver connected to the timing controller through a second communication link and configured to receive the communication signal. The first source driver and the second source driver may receive a restore command from the timing controller in a communication abnormal state and perform a configuration mode, in which options for restoring a communication state are set, according to configuration data received after the restore command.

19 Claims, 4 Drawing Sheets

DISPLAY DRIVING DEVICE AND DISPLAY DEVICE INCLUDING THE SAME

CROSS-REFERENCE TO RELATED APPLICATION

This application claims priority to and the benefit of Korean Patent Application No. 2019-0174231, filed on Dec. 24, 2019, the disclosure of which is incorporated herein by reference in its entirety.

BACKGROUND

Field of the Invention

The present disclosure relates to a display device, and more particularly, to a display driving device and a display device including the same, which are capable of restoring a communication abnormal state to a normal state.

Discussion of Related Art

Generally, display devices include a display panel, a source driver, a timing controller, and the like.

The source driver converts digital image data provided from the timing controller into data voltage and provides the data voltage to the display panel. The source driver may be integrated into an integrated circuit chip (IC chip) and may be configured as a plurality of IC chips in consideration of the size and resolution of the display panel.

Meanwhile, in a display device, when a communication abnormality occurs due to unexpected variables during the communication between a timing controller and source drivers, a case in which communication states are different from each other may occur.

A display device according to the related art has a problem in that communication states between a timing controller and some source drivers are different from each other due to a communication abnormality and thus a display operation is not performed normally.

SUMMARY OF THE INVENTION

The present disclosure is directed to providing a display driving device and a display device including the same, which are capable of restoring a communication abnormal state between a timing controller and a source driver to a normal state.

According to an aspect of the present disclosure, there is provided a display device including a timing controller configured to transmit a communication signal, a first source driver connected to the timing controller through a first communication link and configured to receive the communication signal, and a second source driver connected to the timing controller through a second communication link and configured to receive the communication signal. The first source driver may be connected to the second source driver through a lock link, and the second source driver may be connected to the timing controller through a feedback link. The second source driver may provide a lock signal indicating a communication state to the timing controller through the feedback link, and the first source driver and the second source driver may receive a restore command from the timing controller in a communication abnormal state and perform a configuration mode, in which options for restoring a communication state are set, according to configuration data received after the restore command.

According to another aspect of the present disclosure, there is provided a display driving device including a first source driver connected to a timing controller through a first communication link, and a second source driver connected to the timing controller through a second communication link. The first source driver may be connected to the second source driver through a lock link, and the second source driver may be connected to the timing controller through a feedback link. The second source driver may provide a lock signal indicating a communication state to the timing controller through the feedback link, and when a restore command is received from the timing controller, the first source driver and the second source driver may perform a configuration mode in which at least one of an Internet Protocol (IP) option of the first communication link and the second communication link, an option of a clock data recovery circuit, an option for pre-clock training, and an equalizer option is set.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Embodiments disclose a display driving device and a display device including the same, which enable a communication abnormal state to be restored to a normal state when a communication abnormality occurs due to an unexpected variable during communication between a timing controller and source drivers.

Embodiments disclose a display driving device and a display device including the same, which allow the time for a configuration mode operating at a low frequency to be reduced by defining the length of a data packet, which is variable, in a header to support high-speed data communication.

In embodiments, a restoration protocol or a recovery mode may be defined as a protocol or a mode that makes the communication states between a timing controller and source drivers in the same state.

In embodiments, a configuration protocol, a configuration mode, or a configuration period may be defined as a protocol, a mode, or a period for setting an option of Internet Protocol (IP) of communication links operating at high speed in a display mode, an option of a clock data recovery circuit of a source driver, an option for pre-clock training, and an equalizer option.

In embodiments, a display mode or a display period may be defined as a mode or a period for processing configuration data and image data of a source driver.

In embodiments, pre-clock training or a bandwidth setting period may be defined as a mode or a period for searching for and setting an optimal frequency bandwidth of communication links operating at high speed in a display mode.

In embodiments, equalizer training or an equalizer period may be defined as a mode or a period for setting an equalizer gain level to improve the characteristics of communication links operating at high speed in a display mode.

In embodiments, terms "first," "second," and the like may be used for the purpose of distinguishing a plurality of elements from one another. Here, the terms "first," "second," and the like are not intended to limit the elements.

Figure 1:
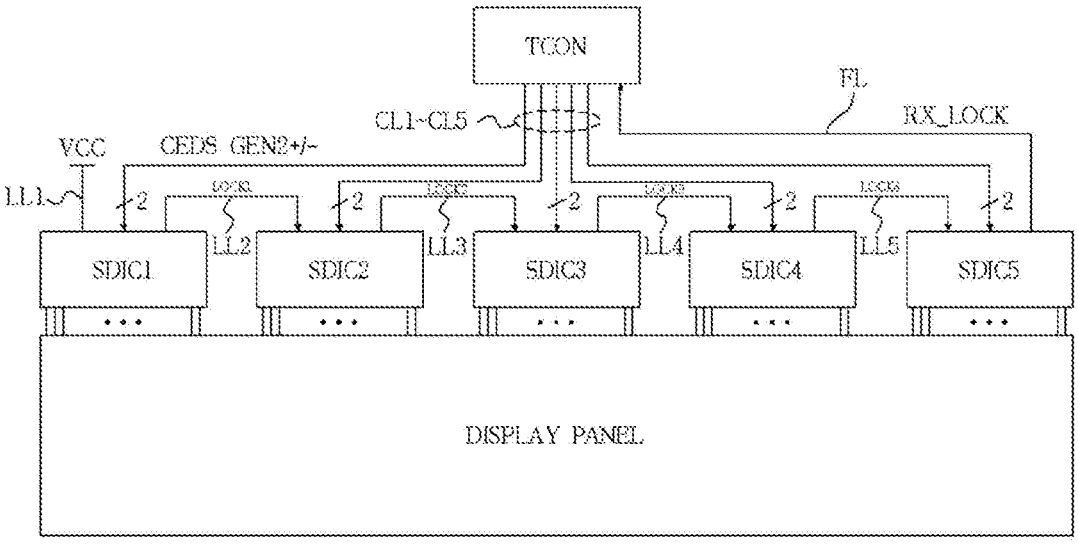
FIG. 1 is a block diagram of a display device according to one embodiment.

FIG. 1 is a block diagram of a display device according to one embodiment.

Referring to FIG. 1, the display device may include a timing controller TCON, a plurality of first to fifth source drivers SDIC1 to SDIC5, and a display panel.

The timing controller TCON may be connected to the plurality of first to fifth source drivers SDIC1 to SDIC5 through first to fifth communication links CL1 to CL5 in a point-to-point manner.

As an example, the timing controller TCON may be connected to the first source driver SDIC1 through the first communication link CL1, and the timing controller TCON may be connected to the second source driver SDIC2 through the second communication link CL2. The timing controller TCON may be connected to the third source driver SDIC3 through the third communication link CL3, and the timing controller TCON may be connected to the fourth source driver SDIC4 through the fourth communication link CL4. The timing controller TCON may be connected to the fifth source driver SDIC5 through the fifth communication link CL5. In addition, each of the first to fifth communication links CL1 to CL5 may be configured as a pair of differential signal lanes.

The timing controller TCON may provide a communication signal CEDS GEN2+/− to the source drivers SDIC1 to SDIC5 through the first to fifth communication links CL1 to CL5, respectively.

In addition, the first to fifth source drivers SDIC1 to SDIC5 may be connected to each other through first to fifth lock links LL1 to LL5 in a cascade manner.

As an example, a power voltage terminal VCC may be connected to the first source driver SDIC1 through the first lock link LL1. The first source driver SDIC1 may be connected to the second source driver SDIC2 through the second lock link LL2, and the second source driver SDIC2 may be connected to the third source driver SDIC3 through the third lock link LL3. The third source driver SDIC3 may be connected to the fourth source driver SDIC4 through the fourth lock link LL4, and the fourth source driver SDIC4 may be connected to the fifth source driver SDIC5 through the fifth lock link LL5. In addition, the fifth source driver SDIC5, which is the last one, may be connected to the timing controller TCON through a feedback link FL.

The first source driver SDIC1 may transmit a first lock signal LOCK1 to the second source driver SDIC2 through the second lock link LL2, and the second source driver SDIC2 may transmit a second lock signal LOCK2 to the third source driver SDIC3 through the third lock link LL3. The third source driver SDIC3 may transmit a third lock signal LOCK3 to the fourth source driver SDIC4 through the fourth lock link LL4, and the fourth source driver SDIC4 may transmit a fourth lock signal LOCK4 to the fifth source driver SDIC5 through the fifth lock link LL5. In addition, the fifth source driver SDIC5 may transmit a fifth lock signal RX_LOCK to the timing controller TCON through the feedback link FL. Here, the fifth lock signal RX_LOCK may indicate a communication state of at least one of the first to fifth source drivers SDIC1 to SDIC5. The fifth lock signal RX_LOCK may be switched to have a value indicating a communication abnormal state when a lock failure occurs in at least one of the first to fifth source drivers SDIC1 to SDIC5.

Figure 2:
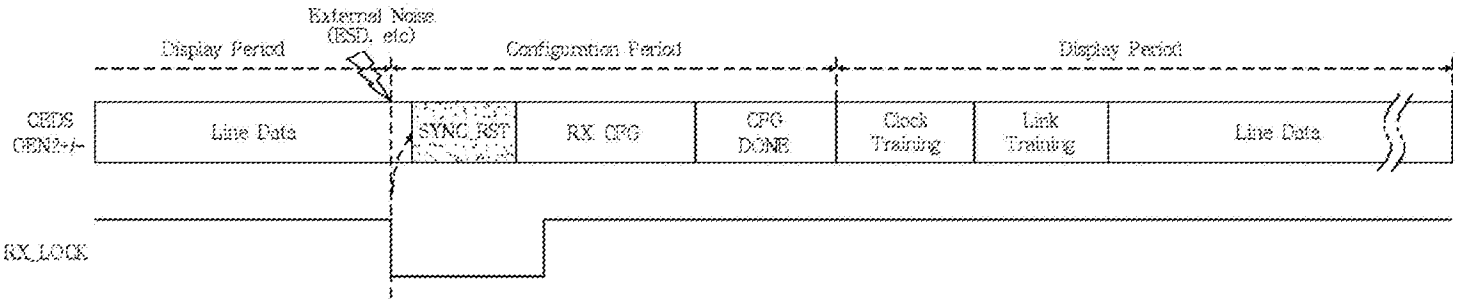
FIG. 2 is a diagram for describing a restoration protocol of the display device according to one embodiment.

FIG. 2 is a diagram for describing a restoration protocol of the display device according to one embodiment.

Referring to FIG. 2, when the communication abnormal state occurs due to external noise such as an electrostatic discharge (ESD) while performing a display mode, the display device may be switched from the display mode to a configuration mode.

As an example, when a lock failure occurs in at least one of the first to fifth source drivers SDIC1 to SDIC5, the fifth source driver SDIC5 may switch the level of the fifth lock signal RX_LOCK from a high level to a low level and provide the fifth lock signal RX_LOCK to the timing controller TCON.

When the lock failure occurs, the timing controller TCON may include a restore command SYNC_RST, for restoring the communication state, in the communication signal CEDS GEN2+/− and transmit the communication signal CEDS GEN2+/− to the first to fifth source drivers SDIC1 to SDIC5 through the first to fifth communication links CL1 to CL5.

As an example, the timing controller TCON may transmit the restore command SYNC_RST having a predetermined level for a predetermined period of time. In addition, the timing controller TCON may transmit a configuration data packet RX CFG to the first to fifth source drivers SDIC1 to SDIC5 after transmitting the restore command SYNC_RST for the predetermined period of time.

The first to fifth source drivers SDIC1 to SDIC5 may receive the restore command SYNC_RST and the configuration data packet RX CFG, and may perform a configuration mode according to the configuration data packet RX CFG. Here, the configuration mode may be defined as a mode for setting an IP option of the first to fifth communication links CL1 to CL5 operating at high speed in the display mode.

In addition, the configuration mode may be set to operate in a low-frequency band compared to the display mode.

In addition, the timing controller TCON may transmit configuration completion data CFG DONE to the first to fifth source drivers SDIC1 to SDIC5 after transmitting the entire configuration data packet RX CFG.

As an example, the timing controller TCON may transmit the configuration completion data CFG DONE, which has a value in which 0 and 1 are continuously toggled for a predetermined period of time, to the first to fifth source drivers SDIC1 to SDIC5.

In addition, when the first to fifth source drivers SDIC1 to SDIC5 receive the configuration completion data CFG DONE from the timing controller TCON, the first to fifth source drivers SDIC1 to SDIC5 may be switched from the configuration mode to the display mode.

The first to fifth source drivers SDIC1 to SDIC5 may restore a phase lock loop (PLL) clock of an internal clock data recovery circuit (not shown) by performing clock training in a display period.

Next, after the clock training in the display period, the first to fifth source drivers SDIC1 to SDIC5 may lock symbol boundary detection and a symbol clock by performing link training.

Next, after the link training in the display period, the first to fifth source drivers SDIC1 to SDIC5 may receive frame data transmitted from the timing controller TCON, convert line data included in the frame data into a data voltage, and provide the data voltage to the display panel.

Figure 3:
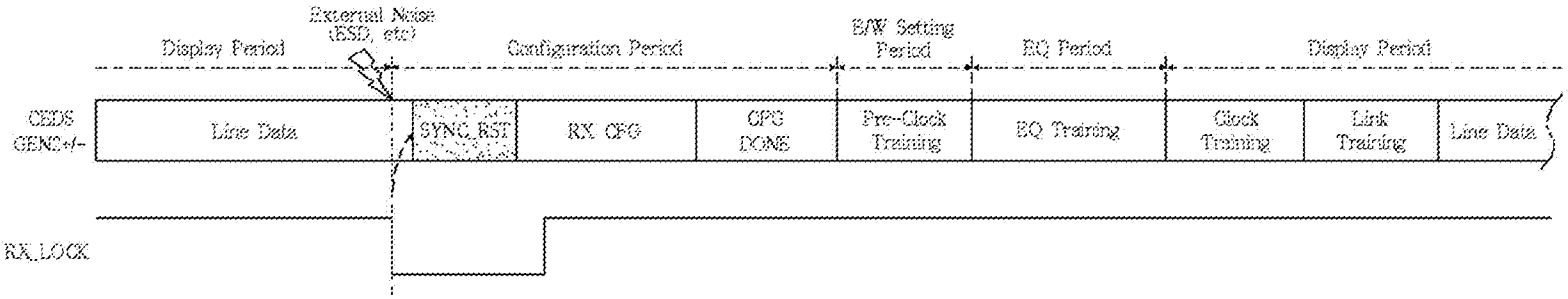
FIG. 3 is a diagram for describing a restoration protocol of a display device according to another embodiment.

FIG. 3 is a diagram for describing a restoration protocol of a display device according to another embodiment. In describing FIG. 3, the description that overlaps that of the embodiment described with reference to FIG. 2 is replaced by the description of FIG. 2.

Referring to FIG. 3, when a communication abnormal state occurs due to external noise, the timing controller TCON may transmit a restore command SYNC_RST having a predetermined level to the first to fifth source drivers SDIC1 to SDIC5 for a predetermined period of time.

Next, after the restore command SYNC_RST is transmitted for the predetermined period of time, the timing controller TCON may transmit a configuration data packet RX CFG to the first to fifth source drivers SDIC1 to SDIC5.

As an example, the timing controller TCON may include a pre-clock training option and an equalizer training option in the configuration data packet RX CFG when transmitting the configuration data packet RX CFG to the first to fifth source drivers SDIC1 to SDIC5.

Next, after a configuration mode is completed, the first to fifth source drivers SDIC1 to SDIC5 may perform pre-clock training to set an optimal frequency bandwidth of the first to fifth communication links CL1 to CL5 operating at high speed in a display mode.

Next, after the pre-clock training is completed, the first to fifth source drivers SDIC1 to SDIC5 may perform equalizer training to set an equalizer gain level in which the characteristics of the communication links operating at high speed in the display mode may be improved.

As an example, the timing controller TCON may repeatedly transmit the pattern of equalizer clock training and equalizer link training during an equalizer period as many times as set in the previous configuration mode.

The first to fifth source drivers SDIC1 to SDIC5 may change the level of the equalizer gain level by a value set in the previous configuration mode.

In addition, each of the first to fifth source drivers SDIC1 to SDIC5 may check locking, symbol locking, and the number of errors of the clock data recovery circuit according to the equalizer gain level thereof.

In addition, the first to fifth source drivers SDIC1 to SDIC5 may compare locking, symbol locking, and the number of errors of the clock data recovery circuit according to the equalizer gain level to select the most effective equalizer gain level, and set the first to fifth communication links CL1 to CL5 accordingly.

Here, the pre-clock training and the equalizer training may be set to operate in a high-frequency band compared to the configuration mode.

In addition, the first to fifth source drivers SDIC1 to SDIC5 may be switched to the display mode after completing the equalizer training.

The first to fifth source drivers SDIC1 to SDIC5 may restore a PLL clock by performing the clock training in the display mode, and may lock symbol boundary detection and a symbol clock by performing the link training.

In addition, the first to fifth source drivers SDIC1 to SDIC5 may convert line data transmitted from the timing controller TCON into a data voltage, and provide the data voltage to the display panel.

As described above, according to the embodiments, when the communication abnormality occurs between the timing controller and the source driver due to unexpected variables, the communication abnormal state may be restored to a normal state at the desired time, thereby preventing a communication failure.

Figure 4:
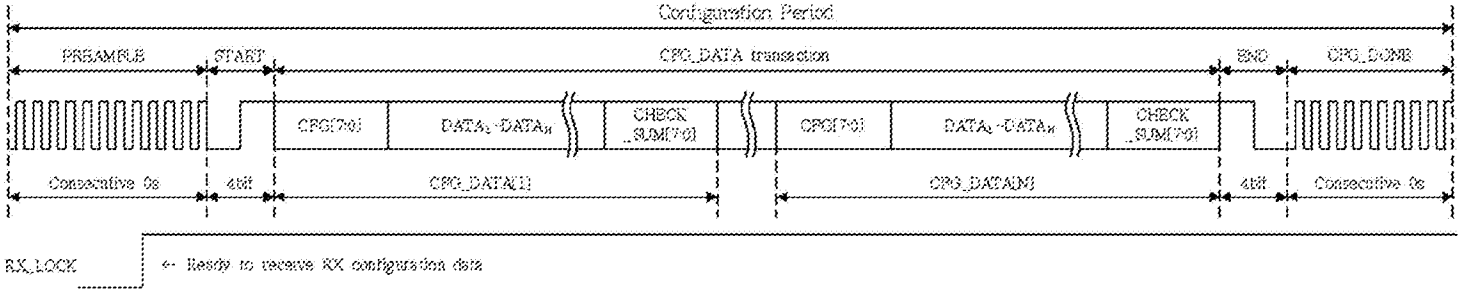
FIG. 4 is a diagram for describing a configuration protocol of the display device according to one embodiment.

Referring to FIG. 4, the source driver may receive a communication signal having a format of preamble data PREAMBLE, start data START, configuration data CFG_DATA, end data END, and configuration completion data CFG_DONE from the timing controller TCON in a configuration mode. The configuration data CFG_DATA may include a header CFG[7:0] that defines the length of data packets DATA1 to DATAN.

The configuration data CFG_DATA may have a format of the header CFG[7:0], the data packets DATA1 to DATAN, and a checksum CHECK_SUM[7:0].

The header CFG[7:0] may define the number of bytes of the data packets DATA1 to DATAN of the current transaction. In addition, the header CFG[7:0] may define the total number of sequences CFG_DATA[1] to CFG_DATA[N] of the configuration data CFG_DATA. In addition, the header CFG[7:0] may define whether the checksum CHECK_SUM [7:0] is activated.

As an example, the header CFG[7:0] may be composed of 8 bits, and a [0] bit of the header CFG[7:0] may be used for synchronization, [3:1] bits of the header CFG[7:0] may be used to define the number of bytes of the data packets DATA1 to DATAN of the current transaction, [6:4] bits of the header CFG[7:0] may be used to define the total number of the sequences CFG_DATA[1] to CFG_DATA[N] of the configuration data CFG_DATA. In addition, a [7] bit of the header CFG[7:0] may define whether the checksum CHECK_SUM[7:0] is activated.

First, the source driver may receive the preamble data PREAMBLE, which is continuously toggled between levels of 0 and 1, in the configuration mode.

Next, when the source driver continuously receives the preamble data PREAMBLE for a predetermined period of time, the source driver may transmit a lock signal RX_LOCK indicating that the source driver is ready to receive the configuration data CFG_DATA to the timing controller TCON. As an example, the source driver may provide the lock signal RX_LOCK by switching from a low level to a high level.

Next, the timing controller TCON may transmit the start data START, the configuration data CFG_DATA, the end data END, and the configuration completion data CFG_DONE to the source driver in response to the lock signal RX_LOCK. Here, the start data START may be set to a level of "0011," and the end data END may be set to a level of "1100."

Next, after the end data END of "1100" is received, the source driver may receive the configuration completion data CFG_DONE continuously toggled between levels of 0 and 1.

Next, when the source driver receives the configuration completion data CFG_DONE for a predetermined period of time, the source driver may perform pre-clock training, equalizer training, or a display mode according to the configuration data CFG_DATA.

As described above, according to the embodiments, when a communication abnormality occurs between a timing controller and a source driver due to unexpected variables, the communication abnormal state can be restored to a normal state at the desired time, thereby preventing a communication failure.

What is claimed is:

1. A display device comprising:

a timing controller configured to transmit a communication signal;

a first source driver connected to the timing controller through a first communication link and configured to receive the communication signal; and a second source driver connected to the timing controller through a second communication link and configured to receive the communication signal, wherein the first source driver is connected to the second source driver through a lock link, and the second source driver is connected to the timing controller through a feedback link, the second source driver provides a lock signal indicating a communication state to the timing controller through the feedback link, and the first source driver and the second source driver receive a restore command from the timing controller in a communication abnormal state and perform a configuration mode, in which options for restoring a communication state are set, according to configuration data received after the restore command.

2. The display device of claim 1, wherein the timing controller is configured to transmit the restore command, having a predetermined level, for a predetermined period of time.

3. The display device of claim 2, wherein after the restore command is transmitted for the predetermined period of time, the timing controller includes a configuration data packet in the communication signal and transmits the communication signal.

4. The display device of claim 3, wherein the first source driver and the second source driver receive the restore command and the configuration data packet and perform the configuration mode according to the configuration data packet.

5. The display device of claim 4, wherein the configuration mode is set to operate in a low-frequency band compared to a frequency band of a display mode.

6. The display device of claim 3, wherein, when the transmission of the configuration data packet is completed, the timing controller transmits configuration completion data to the first source driver and the second source driver.

7. The display device of claim 6, wherein the timing controller transmits the configuration completion data continuously toggled between levels of 0 and 1.

8. The display device of claim 7, wherein, after the configuration mode is completed, the first source driver and the second source driver perform pre-clock training to set a frequency bandwidth.

9. The display device of claim 3, wherein the timing controller includes an option for pre-clock training and an option for equalizer training in the configuration data packet and transmits the configuration data packet.

10. The display device of claim 9, wherein, after the pre-clock training is completed, the first source driver and the second source driver perform the equalizer training to set an equalizer gain level.

11. The display device of claim 10, wherein the pre-clock training and the equalizer training are set to operate in a high-frequency band compared to a frequency band of the configuration mode.

12. A display driving device comprising:

a first source driver connected to a timing controller through a first communication link; and a second source driver connected to the timing controller through a second communication link, wherein the first source driver is connected to the second source driver through a lock link, the second source driver is connected to the timing controller through a feedback link, the second source driver provides a lock signal indicating a communication state to the timing controller through the feedback link, and when a restore command is received from the timing controller, the first source driver and the second source driver perform a configuration mode in which at least one of an Internet Protocol (IP) option of the first communication link and the second communication link, an option of a clock data recovery circuit, an option for pre-clock training, and an equalizer option is set.

13. The display driving device of claim 12, wherein the first source driver and the second source driver are configured to receive the restore command having a predetermined level from the timing controller for a predetermined period of time.

14. The display driving device of claim 13, wherein, after the restore command is received for the predetermined period of time, the first source driver and the second source driver receive a configuration data packet from the timing controller.

15. The display driving device of claim 14, wherein the first source driver and the second source driver perform the configuration mode according to the configuration data packet, and the configuration mode is set to operate in a low-frequency band compared to a frequency band of a display mode.

16. The display driving device of claim 14, wherein the first source driver and the second source driver receive an option for pre-clock training and an option for equalizer training, which are included in the configuration data packet.

17. The display driving device of claim 16, wherein, after the configuration mode is completed, the first source driver and the second source driver perform the pre-clock training to set a frequency bandwidth.

18. The display driving device of claim 17, wherein, after the pre-clock training is completed, the first source driver and the second source driver perform the equalizer training to set an equalizer gain level.

19. The display driving device of claim 18, wherein the pre-clock training and the equalizer training are set to operate in a high-frequency band compared to a frequency band of the configuration mode.

* * * * *